US008365887B2

(12) United States Patent
Fischer

(10) Patent No.: US 8,365,887 B2
(45) Date of Patent: Feb. 5, 2013

(54) RETRACTION APPARATUS

(75) Inventor: Daniel Gerard Fischer, Snow Hill, MD (US)

(73) Assignee: Fischer Consumer Electronics, Pocomoke City, MD (US)

( * ) Notice: Subject to any disclaimer, the term of this patent is extended or adjusted under 35 U.S.C. 154(b) by 237 days.

(21) Appl. No.: 12/970,940

(22) Filed: Dec. 17, 2010

(65) Prior Publication Data

US 2012/0153065 A1 Jun. 21, 2012

(51) Int. Cl.
*H02G 11/02* (2006.01)

(52) U.S. Cl. ..... 191/12.2 R; 191/12.2 A; 191/12.4; 242/389; 242/378.1; 242/378.4; 242/379; 242/385.4

(58) Field of Classification Search ..... 191/12.2 R, 191/12.2 A, 12.4; 242/370, 372, 374–376, 242/378.1, 378.4, 379, 385.4, 389
See application file for complete search history.

(56) References Cited

U.S. PATENT DOCUMENTS

| | | | | |
|---|---|---|---|---|
| 5,094,396 | A | 3/1992 | Burke | |
| 5,339,461 | A | 8/1994 | Luplow | |
| 6,082,656 | A | 7/2000 | Thornton | |
| 6,250,443 | B1 * | 6/2001 | Richter et al. | 191/12.2 R |
| 6,370,401 | B1 | 4/2002 | Baranowski et al. | |
| 6,542,757 | B2 | 4/2003 | Bae | |
| 6,567,651 | B2 | 5/2003 | Whitley | |
| 6,578,683 | B1 * | 6/2003 | Burke et al. | 191/12.4 |
| 6,616,080 | B1 | 9/2003 | Edwards et al. | |
| 6,619,449 | B2 * | 9/2003 | Liao | 191/12.2 R |
| 6,712,304 | B1 | 3/2004 | Taylor | |
| 6,731,956 | B2 | 5/2004 | Hanna et al. | |
| 6,926,130 | B2 | 8/2005 | Skowronski | |
| 7,151,912 | B1 | 12/2006 | Morrison | |
| 7,184,565 | B2 | 2/2007 | Ohta | |
| 7,264,478 | B1 | 9/2007 | Downing | |
| D583,362 | S | 12/2008 | Hsu et al. | |
| 7,515,706 | B2 | 4/2009 | Park | |
| 7,571,874 | B2 | 8/2009 | Zhang et al. | |
| 7,597,179 | B2 * | 10/2009 | Chou | 191/12.2 R |
| 7,599,509 | B2 | 10/2009 | Ito | |
| 2002/0137554 | A1 | 9/2002 | Hanna et al. | |
| 2004/0256188 | A1 | 12/2004 | Harcourt | |
| 2006/0239491 | A1 | 10/2006 | Ito | |
| 2007/0042746 | A1 | 2/2007 | Beard | |
| 2008/0080732 | A1 | 4/2008 | Sneed | |
| 2012/0138725 | A1 * | 6/2012 | Chen et al. | 242/378.1 |

* cited by examiner

*Primary Examiner* — S. Joseph Morano
*Assistant Examiner* — Zachary Kuhfuss
(74) *Attorney, Agent, or Firm* — Lipton, Weinberger & Husick; Ash Tankha

(57) ABSTRACT

A retraction apparatus comprising a support housing comprising one or more generally cylindrical spindles, and a retraction assembly mounted on each of the spindles is provided. The retraction assembly comprises a spring member, a generally cylindrical spool member, a retractable cable, a latch member, and a contact wheel member. The spring member is mounted on each of the spindles and affixed to the support housing. The spool member comprising serrated plates is affixed to the spring member. The retractable cable is circularly wound around a cylindrical section defined between the serrated plates of the spool member and extends outwardly from the support housing. The latch member, in engageable communication with the spool member, controls rotation of the spool member. The contact wheel member, in engageable communication with the spool member, via selective drive mechanisms, is rotated to rotate the spool member for retracting the retractable cable.

25 Claims, 13 Drawing Sheets

RETRACTION APPARATUS

BACKGROUND

Electronic devices, for example, mobile phones, allow a user to have a telephone conversation or listen to radio or prerecorded music using an earphone attached to an end of a cable. Earphones protect the user from radio emissions and allow the user to drive safely by precluding the need to hold the electronic device to the user's ear while using the electronic device. Earphones are of different sizes and produce output at different levels of quality. A particular predetermined length of the cable housing the earphones is not always optimal or ideal for all users. In some cases, cables longer than that required by a user are provided to the user. If the user finds the length of the cable too long, the user tries to reduce the length of the cable by winding some portion of the cable around the electronic device. Winding the cable around the electronic device creates stress on wires inside the cable. Moreover, inadequate housing of the cables may result in cross talk and electronic noise, thereby reducing the quality of an audio signal transmitted though the cable. In addition, when the earphones are not in use, the earphones along with the cable need to be conveniently stored. Usually, users store the earphones in their pockets. In order to answer an incoming call, the users are required to connect the earphones to the mobile phone, which is inconvenient for the users.

To eliminate the stress created on the wires inside the cable, there is a need for a convenient housing for winding the cable in the housing irrespective of the length of the cable and for reducing cross talk and electronic noise. Moreover, there is a need for enclosing the electronic device against the housing to allow a user to conveniently release the cable that houses the earphones and answer an incoming call or listen to the radio or any prerecorded music and retract the cable when not in use. Conventional retraction mechanisms inefficiently retract the cable, which result in tangling of the cable and difficulty in releasing the cable when required.

Moreover, some retraction mechanisms comprise springs used for facilitating winding of the cable in a housing. However, these springs wear out, which disallow retraction of the cable into the housing, thereby causing an inconvenience to the user due to the inability to retract the cable into the housing. Therefore, there is need for additional or secondary provisions for retracting the cable into the housing independent of a single means for retracting the cable.

Hence, there is a long felt but unresolved need for a retraction apparatus that retracts a retractable cable into a support housing, allows mounting of an electronic device adjacent to a retraction mechanism, and provides selective mechanisms for retracting the retractable cable into the support housing.

SUMMARY OF THE INVENTION

This summary is provided to introduce a selection of concepts in a simplified form that are further described in the detailed description of the invention. This summary is not intended to identify key or essential inventive concepts of the claimed subject matter, nor is it intended for determining the scope of the claimed subject matter.

The retraction apparatus disclosed herein addresses the above stated need for an easy to use, compact, semi-permanently attached retraction apparatus that retracts a retractable cable into a support housing and allows mounting of an electronic device, for example, a mobile phone, a tablet computing device, etc., adjacent to a retraction mechanism. The retraction apparatus disclosed herein also provides selective mechanisms, for example, mechanical mechanisms, electric mechanisms, etc., for retracting the retractable cable into the support housing. The retraction apparatus disclosed herein is used for retracting a retractable cable that houses earphones, a microphone, earphones with integral or inline microphones, and/or any device that communicates a signal with the electronic device via the retractable cable.

The retraction apparatus disclosed herein comprises a support housing and a retraction assembly. The support housing comprises one or more generally cylindrical spindles herein referred to as "spindles". The retraction assembly is mounted on each of the spindles of the support housing. The retraction assembly comprises a spring member, a generally cylindrical spool member, a retractable cable, and a contact wheel member. The spring member is mounted on each of the spindles and affixed to the support housing. The generally cylindrical spool member, herein referred to as a "spool member", is affixed to the spring member. The spool member comprises serrated plates that define a cylindrical section between the serrated plates for accommodating the retractable cable. In an embodiment, the serrated plates of the spool member comprise multiple projections that engageably communicate with the contact wheel member via a drive mechanism.

The retractable cable is circularly wound around the cylindrical section defined between the serrated plates of the spool member. The retractable cable extends outwardly from the support housing. The spring member is compressed when the retractable cable is outwardly extended from the support housing. The spring member is decompressed when the retractable cable is retracted into the support housing. The first end of the retractable cable houses, for example, an earphone and/or a microphone. The second end of the retractable cable is connected to the cylindrical section defined between the serrated plates of the spool member.

The contact wheel member is in engageable communication with the spool member via selective drive mechanisms. The contact wheel member is disposed in a predetermined location on the support housing. The contact wheel member is rotated to engageably communicate with a drive mechanism for rotating the spool member for retracting the retractable cable. In an embodiment, the contact wheel member is rearwardly exposed for enabling a user to manually rotate the contact wheel member for rotating the spool member via the drive mechanism. In another embodiment, a section of the contact wheel member is sidewardly exposed for enabling a user to manually rotate the contact wheel member for the rotation of the spool member via the drive mechanism. In another embodiment, a surface of the spool member is rearwardly exposed in the absence of the contact wheel member for enabling a user to manually rotate the spool member. In another embodiment, the spool member comprises one or more spherical depressions on the exposed surface of the spool member contactable by the user for the manual rotation of the contact wheel member.

In an embodiment, the retraction assembly further comprises a latch member in engageable communication with the spool member. The latch member controls the rotation of the spool member. The projections of the serrated plates of the spool member engageably communicate with the latch member. The rotation of the spool member in a first direction disengages the latch member from the spool member to release the spool member for retraction of the retractable cable. The latch member prevents the rotation of the spool member in a second direction opposing the first direction.

In an embodiment, the drive mechanism that engageably connects the contact wheel member to the spool member comprises one or more gears in engageable communication with the spool member for rotating the spool member, on rotation of the contact wheel member. In another embodiment, the drive mechanism comprises a motor operably connected to one or more gears that engageably communicate with the spool member for rotating the spool member on rotation of the motor. The spool member is selectively rotated by the motor or the contact wheel member via the gears.

The retraction apparatus disclosed herein further comprises a printed circuit board fixedly attached to the spring member and embedded in the spool member. The printed circuit board is in electric communication with the retractable cable circularly wound around the spool member via the spring member for communicating, for example, an audio signal from an electronic device, for example, a mobile phone, a tablet computer, etc. The retraction apparatus disclosed herein further comprises an electrical contact fixedly attached to the printed circuit board, for example, via one or more lead wires, for electrically connecting the electronic device to the retraction assembly to communicate the audio signal from the electronic device via the retractable cable of the retraction assembly.

The retraction apparatus disclosed herein further comprises a first enclosing panel detachably attached to a first opposing side of the support housing for enclosing the retraction assembly. The first enclosing panel exposes a surface of the contact wheel member and/or the spool member for manual rotation of the contact wheel member and/or the spool member respectively. The retraction apparatus further comprises a second enclosing panel detachably attached to a second opposing side of the support housing for enclosing the electronic device.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific components and methods disclosed herein.

FIGS. 4A-4B exemplarily illustrate an external view of an embodiment of the retraction apparatus, showing a sidewardly exposed contact wheel member.

DETAILED DESCRIPTION OF THE INVENTION

Figure 1A:
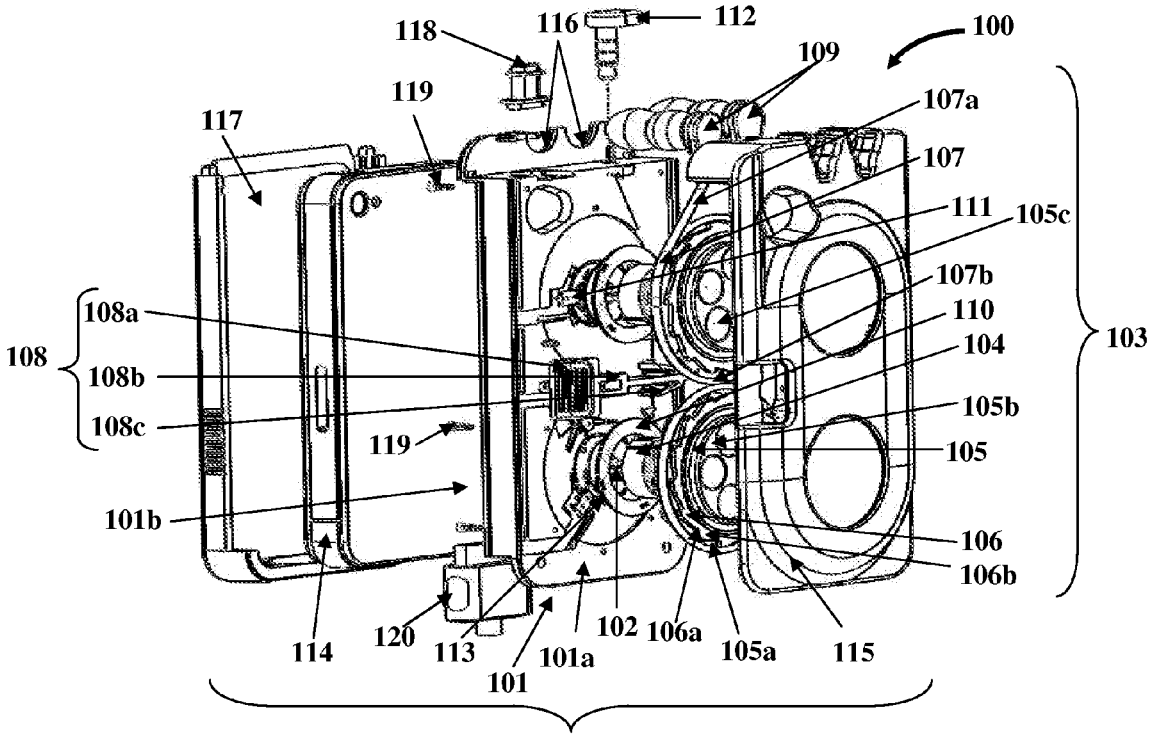
FIGS. 1A-1C exemplarily illustrate exploded views of a retraction apparatus for retracting a retractable cable.
Figure 1B:
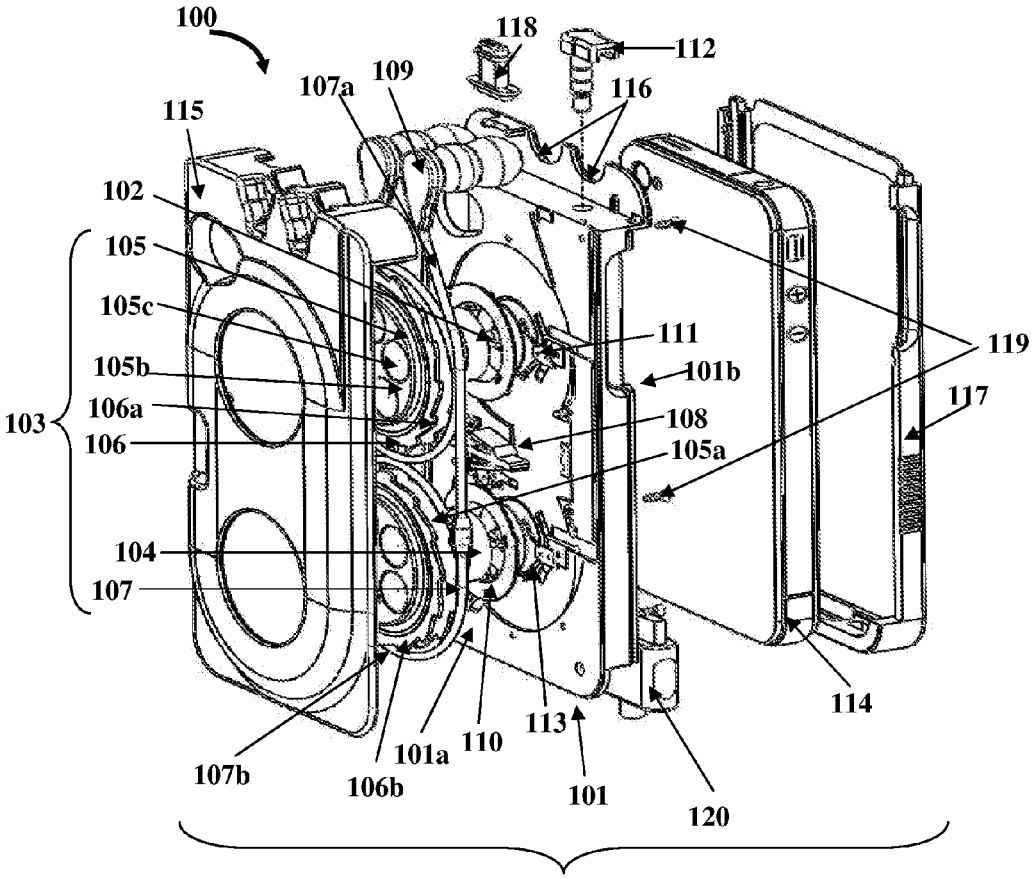
Figure 1C:
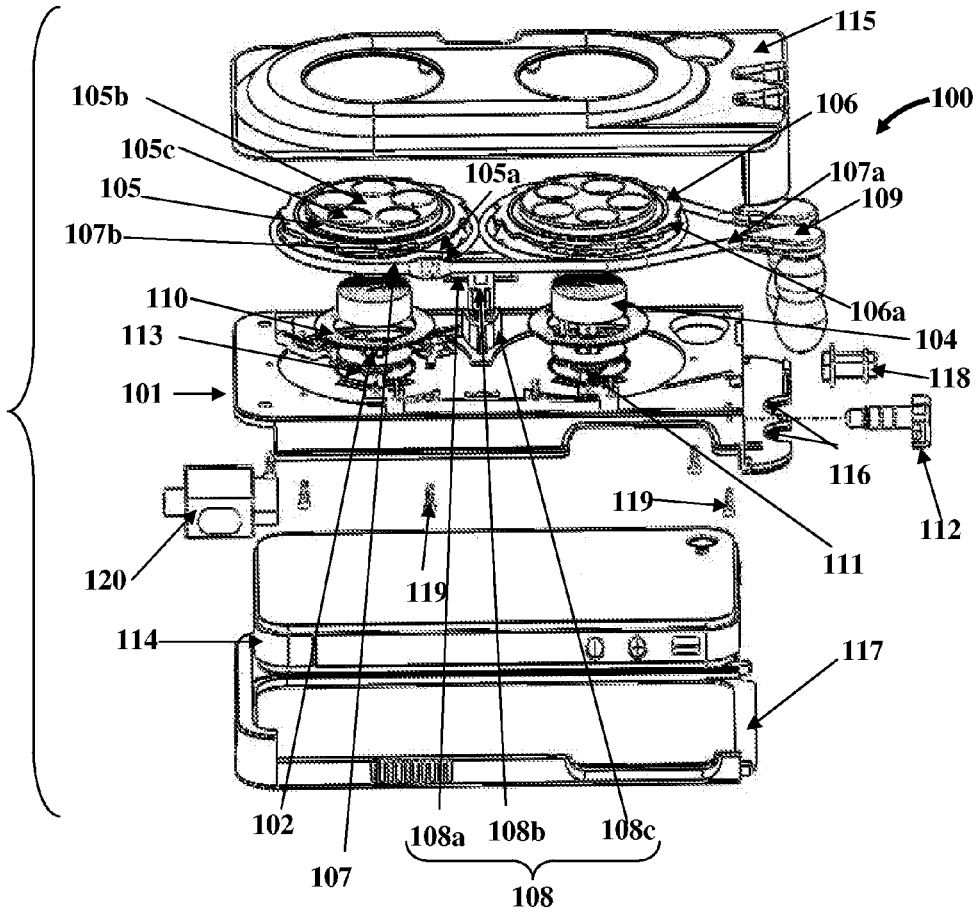

FIGS. 1A-1C exemplarily illustrate exploded views of a retraction apparatus 100 for retracting a retractable cable 107. The retraction apparatus 100 disclosed herein is used for retracting retractable cables 107 that house earphones 109, a microphone, earphones 109 with integral or inline microphones, and/or any device that communicates a signal with an electronic device 114 via retractable cables 107. As used herein, the term "electronic device" refers to a device, for example, a mobile phone, a tablet computing device, a personal digital assistant, a music player, etc., that communicates a signal, for example, an audio signal, via the retractable cable 107. The retraction apparatus 100 disclosed herein comprises a support housing 101 and a retraction assembly 103. The retraction assembly 103 is used for retracting the retractable cable 107 into the support housing 101. The support housing 101 comprises one or more generally cylindrical spindles 102 herein referred to as "spindles". The spindles 102 extend outwardly from the support housing 101 in a generally perpendicular direction on one or more locations on the support housing 101. As exemplarily illustrated in FIGS. 1A-1C, two cylindrical spindles 102 extend outwardly from the support housing 101.

The retraction assembly 103 is mounted on each spindle 102 of the support housing 101. The retraction assembly 103 comprises a spring member 104, a generally cylindrical spool member 105, and a retractable cable 107. The spring member 104, for example, a coil spring, is mounted on each spindle 102 and is affixed to the support housing 101. The spring member 104 is wound in a clockwise direction or a counterclockwise direction. The generally cylindrical spool member 105, herein referred to as a "spool member", is a low-flanged or unflanged cylinder on which a thread, a wire, a cable, a reel, a film, or a tape is wound for use. The spool member 105 is spring-loaded and is affixed to the spring member 104. The spool member 105 comprises serrated plates 106 that define a cylindrical section 105*a* between the serrated plates 106 for accommodating the retractable cable 107. The cylindrical section 105*a* between the serrated plates 106 contacts and accommodates the wound retractable cable 107. The serrated plates 106 of the spool member 105 have ratchet features for allowing rotation of the spool member 105 in only one direction.

In an embodiment, the spool member 105 comprises one or more spherical depressions 105*c* on an exposed surface 105*b* of the spool member 105 for enabling a user to manually rotate the spool member 105. In this embodiment, a surface 105*b* of the spool member 105 is rearwardly exposed in the absence of a contact wheel member 121 exemplarily illustrated in FIG. 2A, FIGS. 3A-3B, and FIGS. 4A-4C, for enabling a user to manually rotate the spool member 105. The user can contact these spherical depressions 105*c* for manually rotating the spool member 105. As exemplarily illustrated in FIGS. 1A-1C, about five spherical depressions 105*c* are provided on the exposed surface 105*b* of the spool member 105. In an embodiment, a single spherical depression 105*c* is provided on the exposed surface 105*b* of the spool member 105 for enabling a user to manually rotate the spool member 105.

The retractable cable 107 is circularly wound around the cylindrical section 105*a* defined between the serrated plates 106 of the spool member 105. The first end 107*a* of the retractable cable 107 houses, for example, an earphone 109 such as a headphone. The second end 107*b* of the retractable cable 107 is connected to the cylindrical section 105*a* defined between the serrated plates 106 of the spool member 105. The retractable cable 107 extends outwardly from the support housing 101. The spring member 104 is compressed when the retractable cable 107 is outwardly extended from the support housing 101. The spring member 104 is decompressed when the retractable cable 107 is retracted into the support housing 101. For example, when the retractable cable 107 is pulled out of the support housing 101, the retractable cable 107 triggers rotation of the spool member 105, which winds up or tightens the spring member 104. When the spool member 105 is released, the spring member 104 unravels and retracts the retractable cable 107.

The retraction apparatus 100 further comprises a contact wheel member 121, as exemplarily illustrated in FIG. 2A, FIGS. 3A-3B, and FIGS. 4A-4C, in engageable communication with the spool member 105 via a drive mechanism 122. The contact wheel member 121 is disposed in a predetermined location on the support housing 101. The serrated plates 106 of the spool member 105 comprise multiple projections 106*a* around the circumference 106*b* of the serrated plates 106 that engageably communicate with the contact wheel member 121 via the drive mechanism 122 as disclosed in the detailed description of FIGS. 2A-2B, FIGS. 3A-3B, and FIGS. 4A-4C. The contact wheel member 121 is rotated to engageably communicate with the drive mechanism 122 for rotating the spool member 105 for retracting the retractable cable 107. Therefore, in addition to providing spherical depressions 105*c* on the exposed surface 105*b* of the spool member 105 for manually rotating the spool member 105, the retraction apparatus 100 disclosed herein provides the contact wheel member 121 to allow the user to retract the retractable cable 107, for example, when the spring member 104 wears out. In another embodiment as disclosed in the detailed description of FIGS. 4A-4C, the user can also retract the retractable cable 107 using an electrically driven motor 129. The user may selectively utilize the contact wheel member 121 or the spherical depressions 105*c* for manually rotating the spool member 105, if the battery 128*a* controlling the motor 129 wears out or the motor 129 fails.

In an embodiment, the retraction apparatus 100 further comprises a latch member 108 in engageable communication with the spool member 105. The latch member 108 is in constant contact with the spool member 105 and controls rotation of the spool member 105. The projections 106*a* of the serrated plates 106 of the spool member 105 around the circumference 106*b* of the serrated plates 106 also engageably communicate with the latch member 108. The latch member 108 comprises a button 108*a* and clamp 108*b* with forked springs 108*c*. On pressing the button 108*a* of the latch member 108 and pulling the retractable cable 107 out of the support housing 101, the spool member 105 rotates causing the forked springs 108*c* of the latch member 108 to collapse. The rotation of the spool member 105 tightens the spring member 104, thereby creating a tension in the spring member 104. The projections 106*a* on the serrated plates 106 of the spool member 105 pass the forked springs 108*c*. The forked springs 108*c* snap behind the projections 106*a* on the serrated plates 106 thereby preventing the spool member 105 from rotating in a direction opposite to the direction of pull of the retractable cable 107. As the retractable cable 107 housing, for example, the earphones 109 are pulled out of the support housing 101, the latch member 108 locks the spool members 105 in place at any given length. On depressing the button 108*a*, the clamp 108*b* linearly slides to disengage the forked springs 108*c* from the spool member 105 and unravel the spring member 104. The spool member 105 winds up under the tension created in the spring member 104 to retract the retractable cable 107 into the support housing 101. The earphones 109 housed on separate retractable cables 107 can be retracted independently or simultaneously.

The retraction apparatus 100 disclosed herein further comprises a printed circuit board 110 fixedly attached to the spring member 104 and embedded in the spool member 105. The printed circuit board 110 is in electric communication with the retractable cable 107 circularly wound around the spool member 105 via the spring member 104 for communicating, for example, an audio signal from an electronic device 114, for example, a mobile phone. For the purpose of illustration, the detailed description refers to mounting and accommodating a mobile phone within the support housing 101 and an enclosing panel 117, however the scope of the retraction apparatus 100 disclosed herein may be extended to mount and accommodate other electronic devices, for example, tablet computing devices, personal digital assistants (PDAs), music players, portable media players, cordless phones, and other electronic devices that utilize retractable cables 107 to communicate signals, for example, audio signals. The retraction apparatus 100 disclosed herein further comprises a power switch 118 for switching the electronic device 114 on and off and a plug 112 to plug in the electronic device 114, for example, to a power supply. The power switch 118 enables the user to activate or deactivate the electronic device 114 without taking the electronic device 114 out of the retraction apparatus 100. The retraction assembly 103 disclosed herein further comprises an electrical contact 111 fixedly attached to the printed circuit board 110, for example, via one or more lead wires 113, for electrically connecting the electronic device 114 to the retraction assembly 103 to communicate the audio signal from the electronic device 114 via the retractable cable 107 of the retraction assembly 103.

The retraction apparatus 100 disclosed herein further comprises a first enclosing panel 115 detachably attached to a first opposing side 101*a* of the support housing 101 for enclosing the retraction assembly 103. The earphones 109 are accommodated in holders 116 defined on the support housing 101. The holders 116 allow for safe storage of the earphones 109 when they are not in use. The first enclosing panel 115 exposes the contact wheel member 121 or a surface 105*b* of the spool member 105 for manual rotation of the contact wheel member 121 or the spool member 105 respectively. The retraction apparatus 100 further comprises a second enclosing panel 117 detachably attached to a second opposing side 101*b* of the support housing 101 for enclosing the electronic device 114. The second enclosing panel 117 enables secure storage of the electronic device 114. The electronic device 114 is mounted on the second opposing side 101*b* of the support housing 101 and enclosed between the second enclosing panel 117 and the support housing 101 using fasteners 119, for example, screws, adhesives, etc. The retraction apparatus 100 therefore creates a modular packaging platform for the electronic device 114. The retraction apparatus 100 further comprises a power supply input 120 connected to the electronic device 114 for supplying power to the electronic device 114 and a motor 129 as disclosed in the detailed description of FIG. 4C.

Figure 2A:
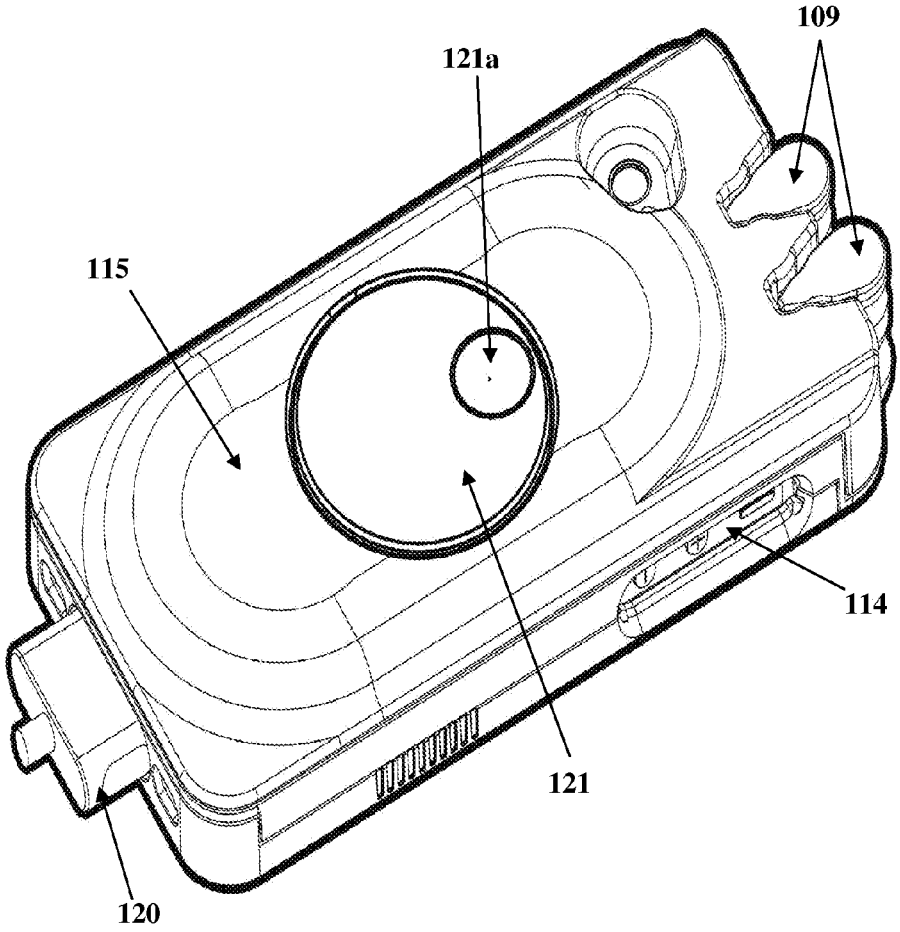
FIG. 2A exemplarily illustrates an external view of an embodiment of the retraction apparatus, showing a rearwardly exposed contact wheel member.

FIG. 2A exemplarily illustrates an external view of an embodiment of the retraction apparatus 100, showing a rearwardly exposed contact wheel member 121. In this embodiment, the contact wheel member 121 is rearwardly exposed for enabling a user to manually rotate the contact wheel member 121 for rotating the spool member 105 via the drive mechanism 122 exemplarily illustrated in FIG. 2B. The contact wheel member 121 is disposed on top of the spool members 105. The contact wheel member 121 comprises, for example, a single spherical depression 121*a*. A user may use a finger to contact the spherical depression 121*a* for manually rotating the contact wheel member 121. The contact wheel member 121 is configured to provide an improved grip to the user for manual rotation.

Figure 2B:
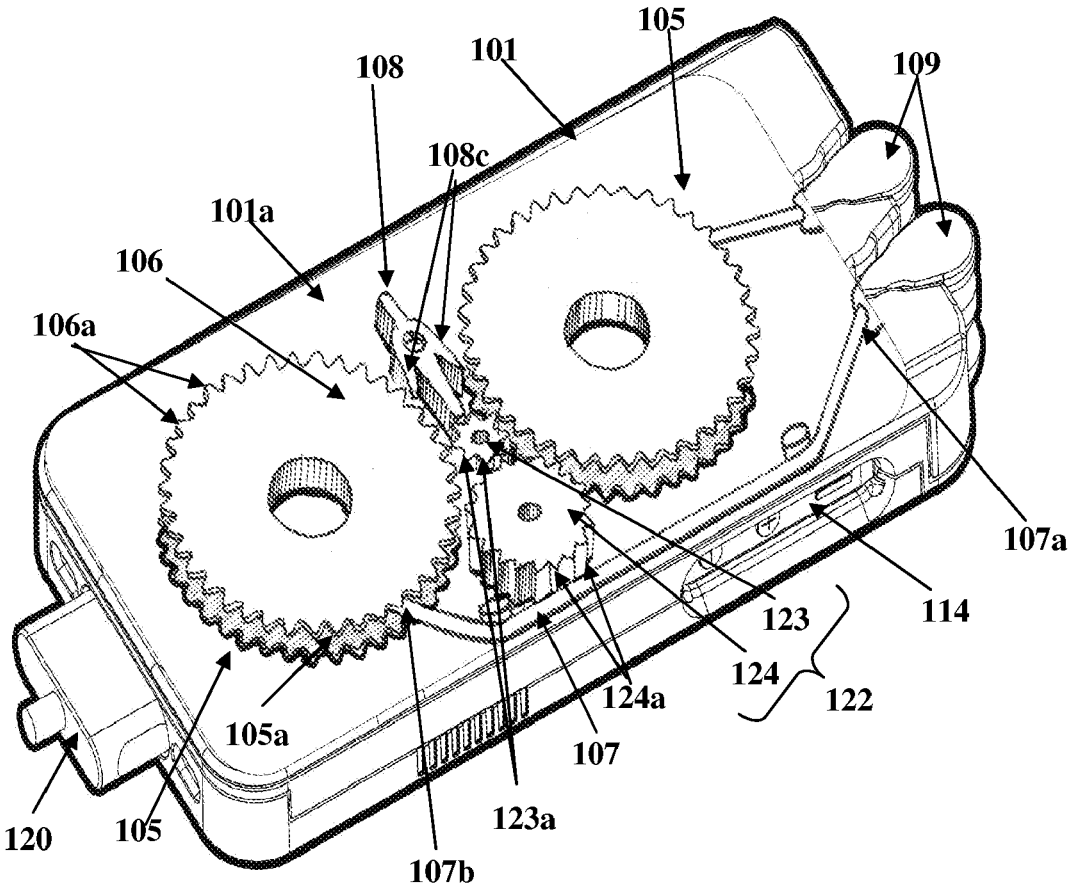
FIG. 2B exemplarily illustrates an internal view of the embodiment of the retraction apparatus shown in FIG. 2A, where the rearwardly exposed contact wheel member engages spool members of a retraction assembly via a drive mechanism.

FIG. 2B exemplarily illustrates an internal view of the embodiment of the retraction apparatus 100 shown in FIG. 2A, where the rearwardly exposed contact wheel member 121 engages the spool members 105 of the retraction assembly 103 via the drive mechanism 122. In this embodiment, the drive mechanism 122 comprises one or more gears 123 and 124 in engageable communication with each spool member 105 for rotating each spool member 105, on rotation of the contact wheel member 121. The contact wheel member 121 contacts the latch member 108. The forked springs 108*c* of the latch member 108 are in constant contact with the projections 106*a* of the serrated plates 106 of the spool members 105. The latch member 108 engageably communicates with each spool member 105. As exemplarily illustrated in FIG. 2B, the drive mechanism 122 comprises a first gear 123 and a second gear 124 engageably connected to each spool member 105 for rotating each spool member 105. The teeth 123*a* of the first gear 123 are in engageable communication with the teeth 124*a* of the second gear 124. The manual rotation of the contact wheel member 121 by the user drives the first gear 123, which in turn drives the second gear 124 by the engageable communication of the teeth 123*a* and 124*a* respectively. The rotation of the first gear 123 in combination with the second gear 124 rotates the spool members 105. When the contact wheel member 121 is contacted or pressed by the user, the contact wheel member 121 disengages the latch member 108 and/or the gears 123 and 124 from the spool members 105, thereby causing the spool members 105 to wind back and retract the retractable cable 107. The user can manually rotate the contact wheel member 121 for desired retraction of the retractable cable 107. The teeth 123*a* and 124*a* of the gears 123 and 124 respectively control speed of rotation of the spool members 105 of the retraction assembly 103.

Figure 3A:
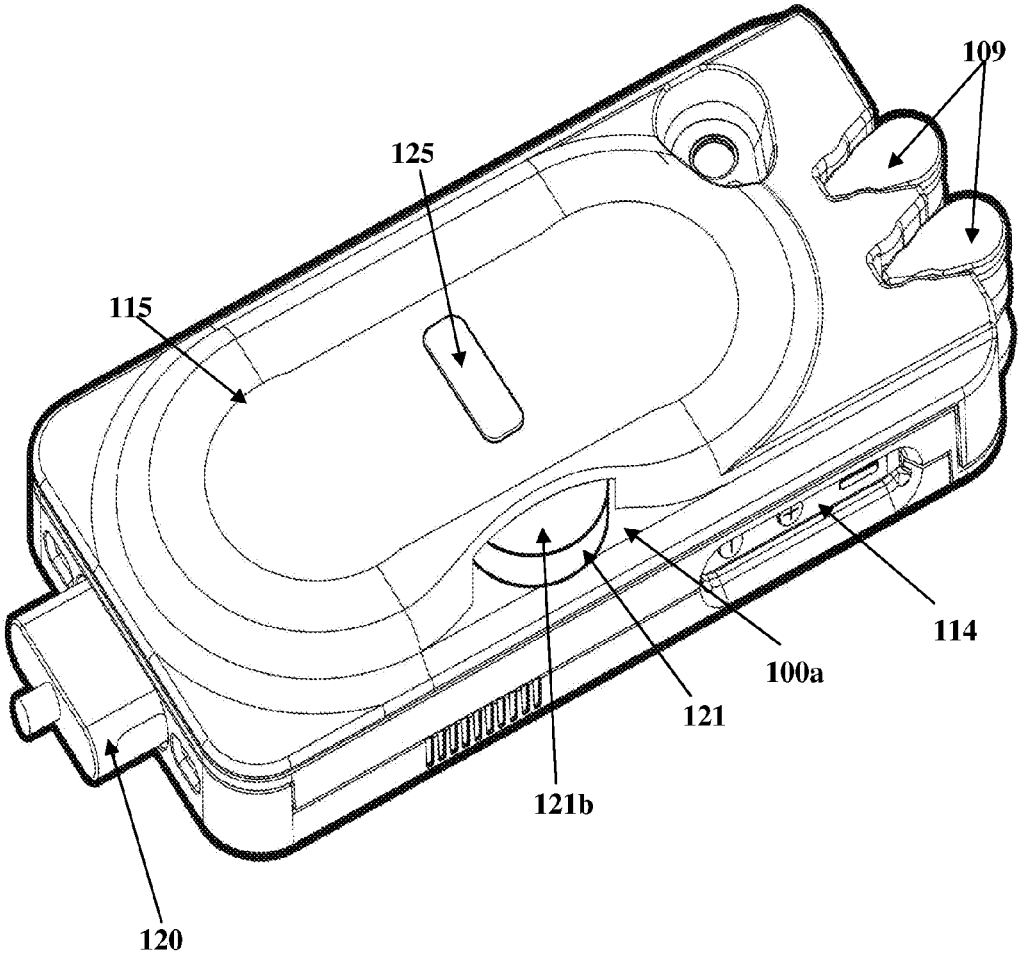
FIG. 3A exemplarily illustrates an external view of an embodiment of the retraction apparatus, showing a sidewardly exposed contact wheel member.

FIG. 3A exemplarily illustrates an external view of an embodiment of the retraction apparatus 100, showing a sidewardly exposed contact wheel member 121. In this embodiment, a section 121*b* of the contact wheel member 121 is sidewardly exposed for enabling a user to manually rotate the contact wheel member 121 for rotating the spool member 105 via the drive mechanism 122. In this embodiment, the contact wheel member 121 is disposed on the side 100*a* of the retraction apparatus 100 along the plane of the support housing 101. The section 121*b* of the contact wheel member 121 extends outwardly from the first enclosing panel 115. A user may use a finger to contact the sidewardly exposed contact wheel member 121 for manually rotating the contact wheel member 121. The contact wheel member 121 is configured to provide an improved grip to the user for manual rotation.

Figure 3B:
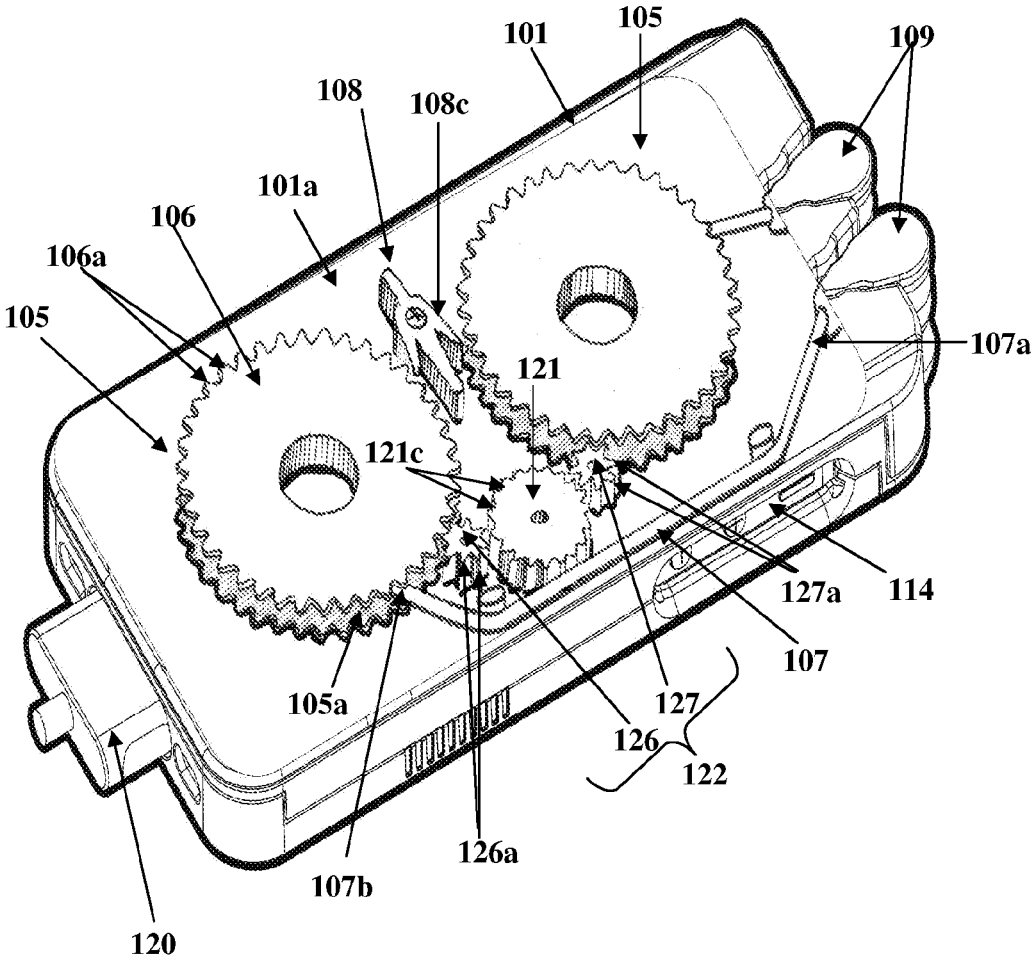
FIG. 3B exemplarily illustrates an internal view of the embodiment of the retraction apparatus shown in FIG. 3A, where the sidewardly exposed contact wheel member engages the spool members of the retraction assembly via a drive mechanism.

FIG. 3B exemplarily illustrates an internal view of the embodiment of the retraction apparatus 100 shown in FIG. 3A, where the sidewardly exposed contact wheel member 121 engages with the spool members 105 of the retraction assembly 103 via the drive mechanism 122. In this embodiment, the drive mechanism 122 comprises a first gear 126 and a second gear 127 positioned on opposing sides of the contact wheel member 121. The teeth 126*a* and 127*a* of the first gear 126 and the second gear 127 respectively are in engageable communication with the teeth 121*c* of the contact wheel member 121. The first gear 126 and the second gear 127 engageably communicate with each spool member 105 for rotating each spool member 105. The manual rotation of the contact wheel member 121 by the user drives the first gear 126 and the second gear 127 which in turn, rotate each spool member 105.

When the user rotates the contact wheel member 121, the contact wheel member 121 disengages the gears 126 and 127 from the spool members 105, thereby causing the spool members 105 to wind back and retract the retractable cable 107. The user can manually rotate the contact wheel member 121 for desired retraction of the retractable cable 107. The first gear 126 in combination with the second gear 127 controls the speed of rotation of each spool member 105 of the retraction assembly 103. The ratio of the number of teeth 121*c* on the contact wheel member 121 to the number of teeth 126*a* on the first gear 126 and the number of teeth 127*a* on the second gear 127 controls the speed of retraction of the retractable cable 107 around the spool member 105.

On pressing a button 125 exemplarily illustrated in FIG. 3A and pulling the retractable cable 107 out of the support housing 101, the spool member 105 rotates causing the forked springs 108*c* of the latch member 108 to collapse. The projections 106*a* on the serrated plates 106 of the spool member 105 pass the forked springs 108*c* of the latch member 108. The forked springs 108*c* snap behind the projections 106*a* on the serrated plates 106, thereby preventing the spool member 105 from rotating in a direction opposite to the direction of pull of the retractable cable 107. As the retractable cable 107 housing the earphones 109 are pulled out of the support housing 101, the latch member 108 locks the spool members 105 in place at any given length. On depressing the button 125, the latch member 108 linearly slides to disengage the forked springs 108*c* from the spool member 105. The spool member 105 winds up to retract the retractable cable 107 into the support housing 101.

Figure 4A:
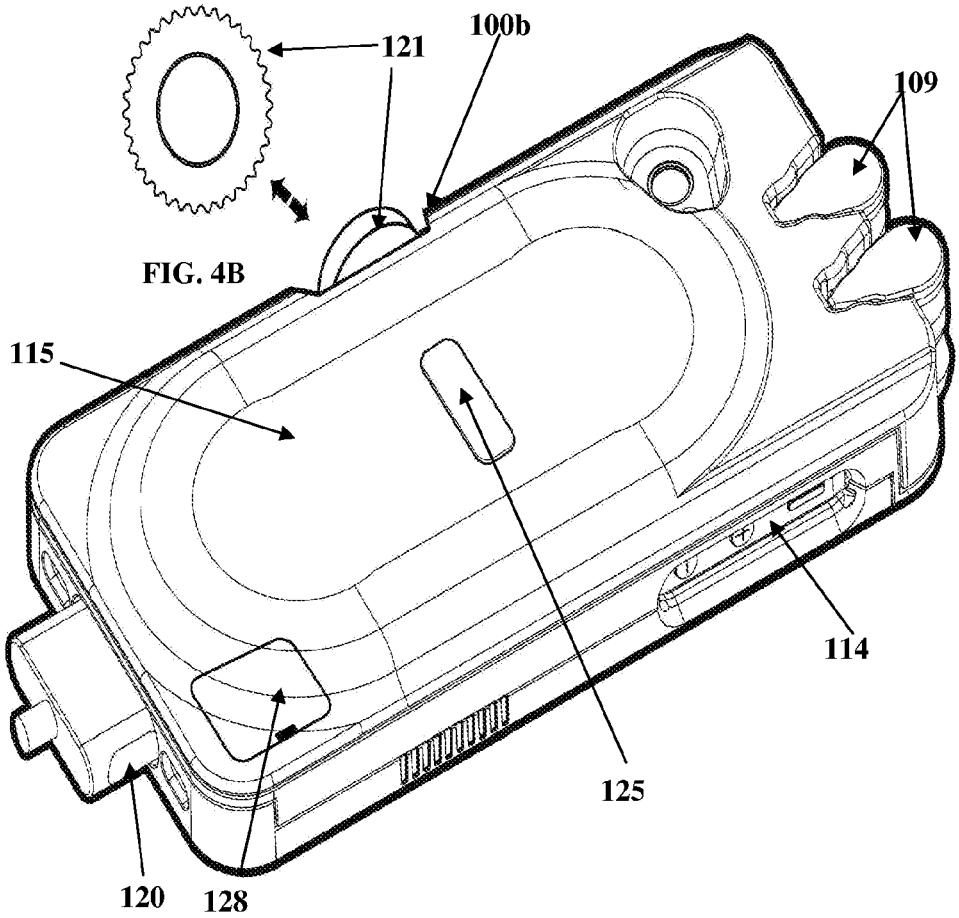

FIG. 4A-4B exemplarily illustrates an external view of an embodiment of the retraction apparatus 100, showing a sidewardly exposed contact wheel member 121. In this embodiment, the contact wheel member 121 is disposed on the side 100*b* of the retraction apparatus 100. A front view of the contact wheel member 121 is exemplarily illustrated in FIG. 4B. A user may use a finger to press and contact the sidewardly exposed contact wheel member 121 for manually rotating the contact wheel member 121 for controlling the rotation of each spool member 105 via the drive mechanism 122. The contact wheel member 121 is configured in the form of a thumb wheel to provide improved grip to the user for manual rotation. A button 125 is provided on the first enclosing panel 115, which communicates with the drive mechanism 122 for disengaging the drive mechanism 122 inside the support housing 101. The retraction apparatus 100 comprises a battery compartment 128 that houses a battery 128*a*. The battery 128*a* is rechargeable by the power supply input 120 when the power supply input 120 is plugged in. The battery 128*a* and/or the power supply input 120 provide power to drive a motor 129 for rotating the spool members 105.

Figure 4C:
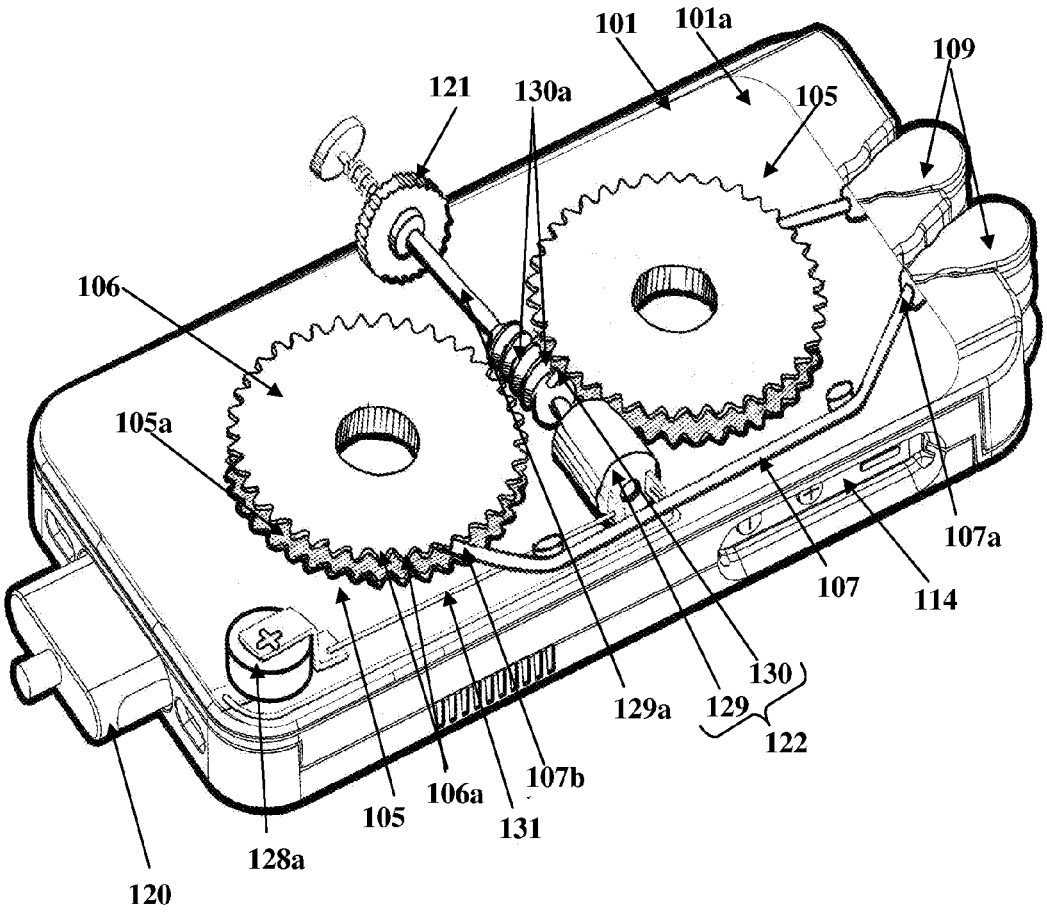
FIG. 4C exemplarily illustrates an internal view of the embodiment of the retraction apparatus shown in FIG. 4A, where the spool members of the retraction assembly are driven by the sidewardly exposed contact wheel member or a motor of a drive mechanism.

FIG. 4C exemplarily illustrates an internal view of the embodiment of the retraction apparatus 100 shown in FIG. 4A, where the spool members 105 of the retraction assembly 103 are driven by the sidewardly exposed contact wheel member 121 or a motor 129 of the drive mechanism 122. In this embodiment, the drive mechanism 122 comprises the motor 129 having a shaft 129*a* operably connected to one or more gears, for example, a worm gear 130 that engageably communicates with the spool member 105 for rotating the spool member 105, on rotation of the motor 129. The shaft 129*a* of the motor 129 is also connected to the contact wheel member 121. The motor 129 is electrically connected to the battery 128*a* and the power supply input 120, for example, by an electrical wire 131. In order to drive the motor 129 for rotating the spool members 105, power from the power supply input 120 is transmitted directly to the motor 129 or via the battery 128*a* through the electrical wire 131. The user may trigger the transmission of power to the motor 129 by pressing the button 125 exemplarily illustrated in FIG. 4A. The motor 129 rotates causing the worm gear 130 disposed on the shaft 129*a* of the motor 129 to rotate. The threads 130*a* of the worm gear 130 meshes with each spool member 105 causing each spool member 105 to rotate for retracting the retractable cable 107. The button 125, when depressed, may disengage the drive mechanism 122 and allow for manual rotation using the contact wheel member 121.

In another embodiment, the contact wheel member 121 may be manually turned to wind or unwind the retractable cable 107 around the spool member 105. The retraction apparatus 100 disclosed herein can therefore be finger-driven when the electrically driven motor 129 is out of battery power or is damaged, or can be electrically driven when the spring member 104 affixed to the spool member 105, as disclosed in the detailed description of FIGS. 1A-1C, is worn or damaged. The spool member 105 is selectively rotated by the motor 129 or the contact wheel member 121 via the gears 130. The retraction apparatus 100 disclosed herein therefore provides selective mechanisms, for example, mechanical rotation of the spool member 105 using the contact wheel member 121, mechanical rotation of the spool member 105 via the spherical depressions 105*c* on the exposed surface 105*b* of the spool member 105, and/or electric rotation of the spool member 105 via the motor 129 for retracting the retractable cable 107 into the support housing 101. The contact wheel member 121, the spherical depressions 105*c*, and the motor 129 of the retraction apparatus 100 disclosed herein can be interchangeably used for retracting the retractable cable 107 into the support housing 101. The retractable apparatus 100 disclosed herein therefore provides a modular changeable platform for retracting the retractable cable 107 into the support housing 101. The retractable apparatus 100 disclosed herein can be easily implemented with multiple current and future host electronic devices.

Figure 5A:
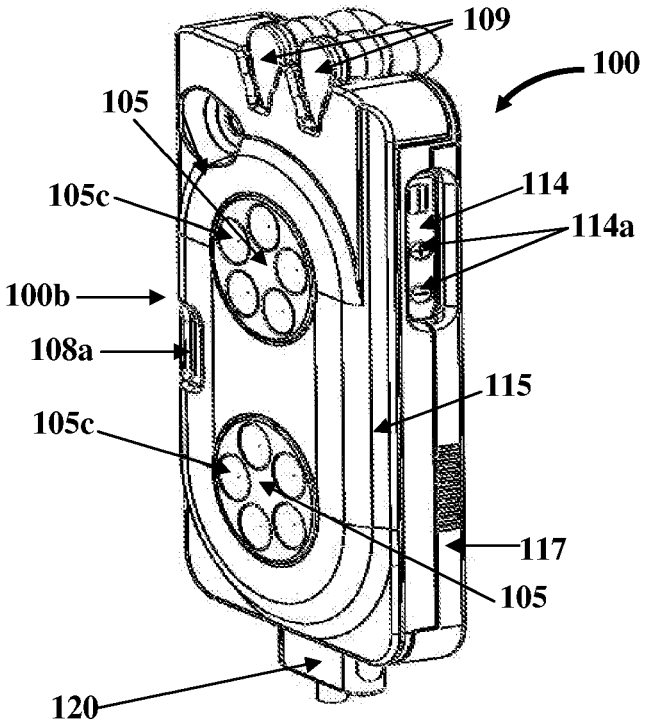
FIGS. 5A-5C exemplarily illustrate assembled views of the retraction apparatus.
Figure 5B:
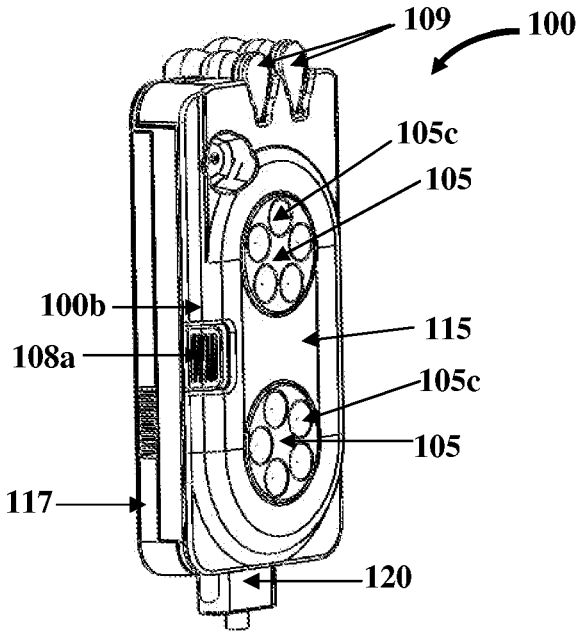
Figure 5C:
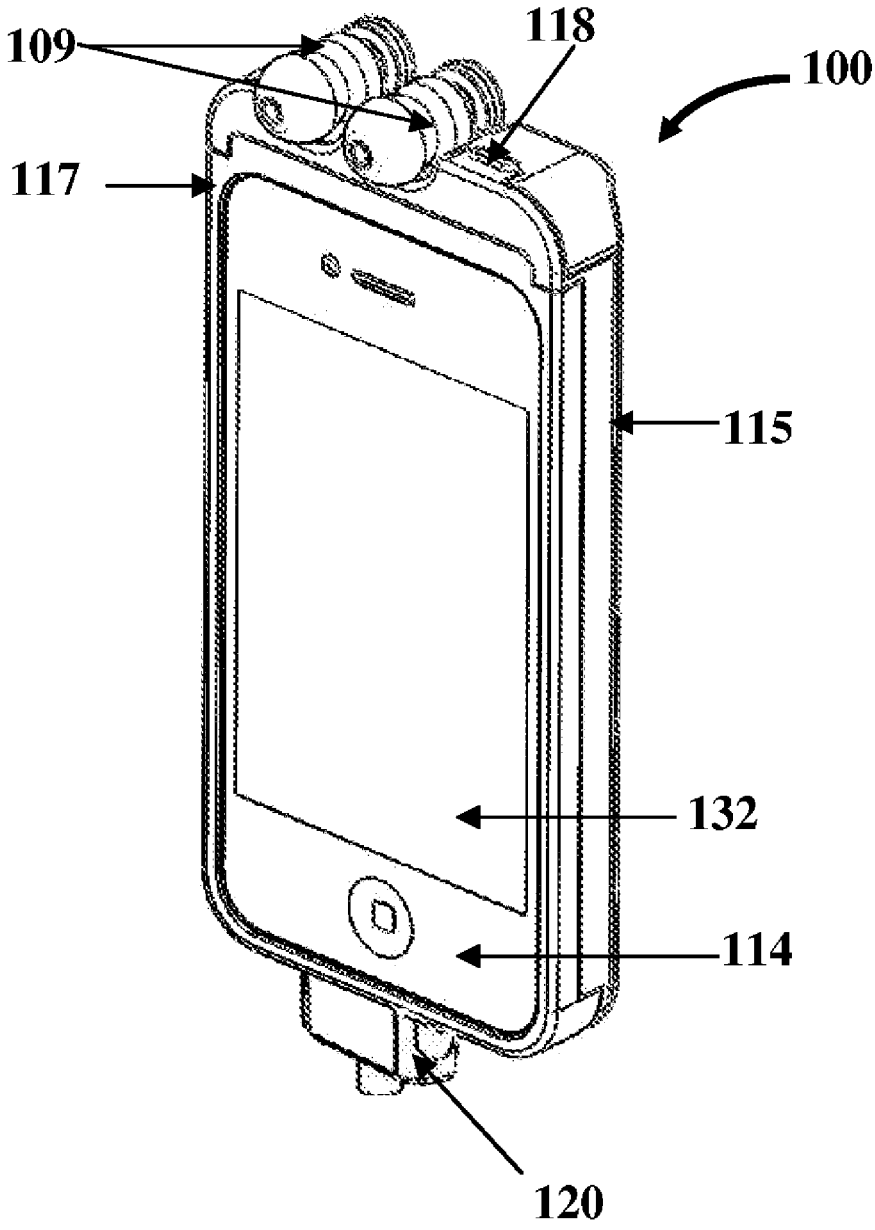

FIGS. 5A-5C exemplarily illustrate assembled views of the retraction apparatus 100. The assembled views of the retraction apparatus 100 display the earphones 109 housed at the first end 107*a* of the retractable cable 107 in a retracted position. A first enclosing panel 115 is detachably attached to the first opposing side 101*a* of the support housing 101 for enclosing the retraction assemblies 103. The first enclosing panel 115 exposes a surface 105*b* of the spool member 105 for manual rotation of the spool member 105. The exposed surface 105*b* of each spool member 105 comprises spherical depressions 105*c* contactable by a user for facilitating manual rotation of the spool member 105 as exemplarily illustrated in FIGS. 5A-5B. The retraction apparatus 100 further comprises a second enclosing panel 117 detachably attached to a second opposing side 101*b* of the support housing 101 for enclosing an electronic device 114. The second enclosing panel 117 comprises a frontward opening 132 for viewing an interface of the electronic device 114 as exemplarily illustrated in FIG. 5C. Interfacing components, speakers, camera lenses, buttons 114*a*, etc., of the electronic device 114 are accessible through the edges of the first enclosing panel 115 and the second enclosing panel 117. The retraction apparatus 100 exposes the button 108*a* of the latch member 108 on the side 100*b* of the retraction apparatus 100. The button 108*a* of the latch member 108 travels linearly. For example, when you depress the button 108*a*, the button 108*a* slides inward into the support housing 101 and moves the forked springs 108*c* of the latch member 108 out of engagement with the spool members 105. The spool members 105 wind the pulled out retractable cables 107 into the support housing 101 under the tension of the spring members 104. The earphones 109 are housed at the first end 107*a* of the retractable cable 107 and are accommodated in the holders 116 provided in the support housing 101.

Figure 6:
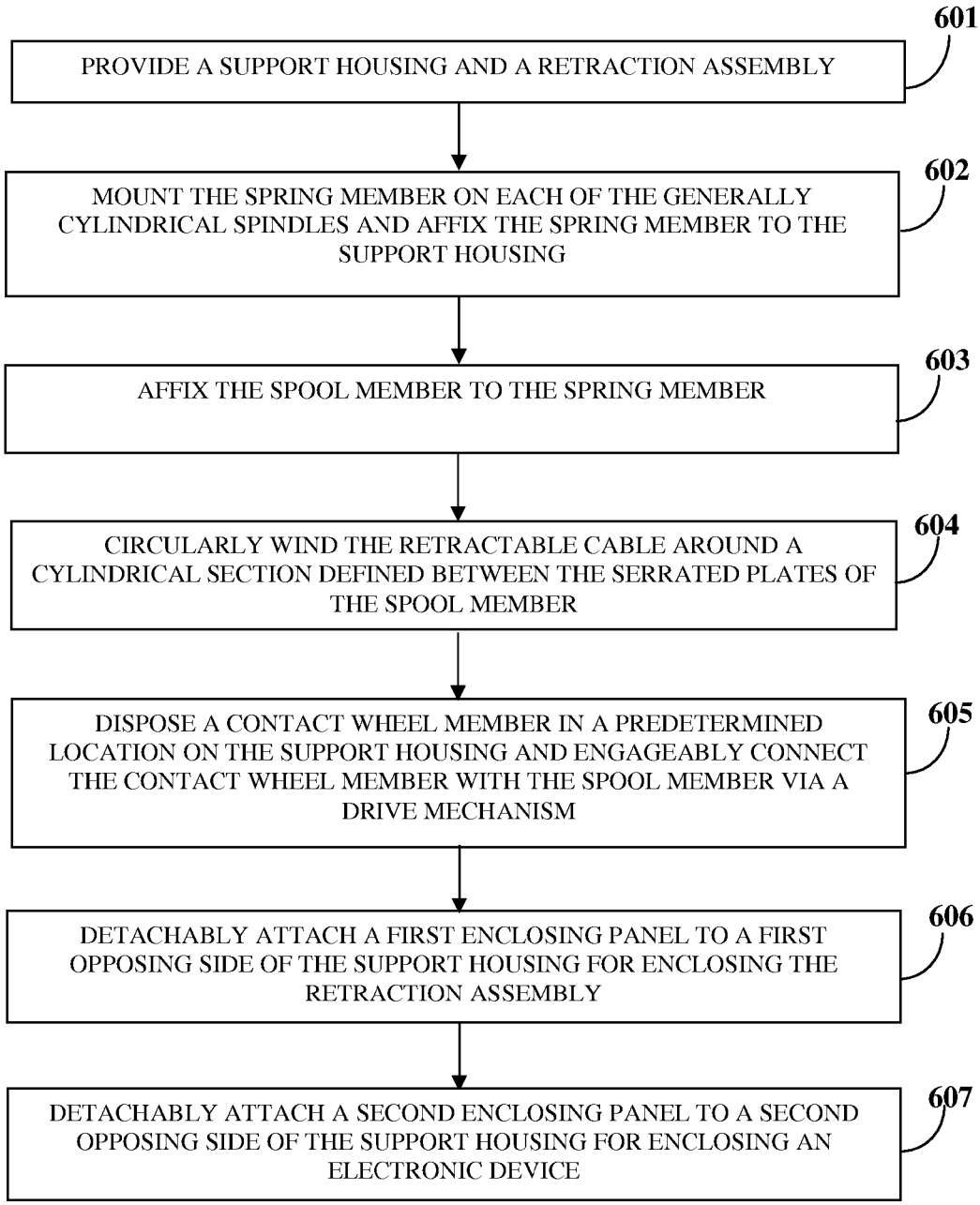
FIG. 6 illustrates a method for assembling a retraction apparatus.

FIG. 6 illustrates a method for assembling a retraction apparatus 100. The retraction apparatus 100 provides 601*a* support housing 101 and a retraction assembly 103. The support housing 101 comprises one or more generally cylindrical spindles 102. The retraction assembly 103 is mounted on each of the spindles 102 of the support housing 101. The retraction assembly 103 further comprises a spring member 104, a generally cylindrical spool member 105, a retractable cable 107, and a contact wheel member 121. The spring member 104 is mounted 602 on the spindle 102 and affixed 602 to the support housing 101. The spool member 105 is affixed 603 to the spring member 104. The retractable cable 107 is circularly wound 604 around a cylindrical section 105*a* defined between the serrated plates 106 of the spool member 105. The retractable cable 107 extends outwardly from the support housing 101.

The contact wheel member 121 is disposed 605 in a predetermined location on the support housing 101 and is engageably connected 605 to the spool member 105 via a drive mechanism 122 as disclosed in the detailed description of FIGS. 2A-2B, FIGS. 3A-3B, and FIGS. 4A-4C. The contact wheel member 121 is rotated to engageably communicate with the drive mechanism 122 for rotating the spool member 105 for retracting the retractable cable 107. In an embodiment, a latch member 108 is engageably connected to the spool member 105 for controlling rotation of the spool member 105 for retracting the retractable cable 107. A first enclosing panel 115 is detachably attached 606 to a first opposing side 101*a* of the support housing 101 for enclosing the retraction assembly 103. The first enclosing panel 115 exposes the contact wheel member 121 or a surface 105*b* of the spool member 105 for manual rotation of the contact wheel member 121 or the spool member 105 respectively. A second enclosing panel 117 is detachably attached 607 to a second opposing side 101*b* of the support housing 101 for enclosing the electronic device 114.

A printed circuit board 110 is fixedly attached to the spring member 104 and embedded in the spool member 105. The printed circuit board 110 is in electronic communication with the retractable cable 107 circularly wound around the spool member 105 via the spring member 104 for communicating an audio signal from the electronic device 114. Moreover, an electrical contact 111 is fixedly attached to the printed circuit board 110, for example, via one or more lead wires 113, for electrically connecting the electronic device 114 to the retraction assembly 103 to communicate the audio signal from the electronic device 114 via the retractable cable 107 of the retraction assembly 103.

Figure 7:
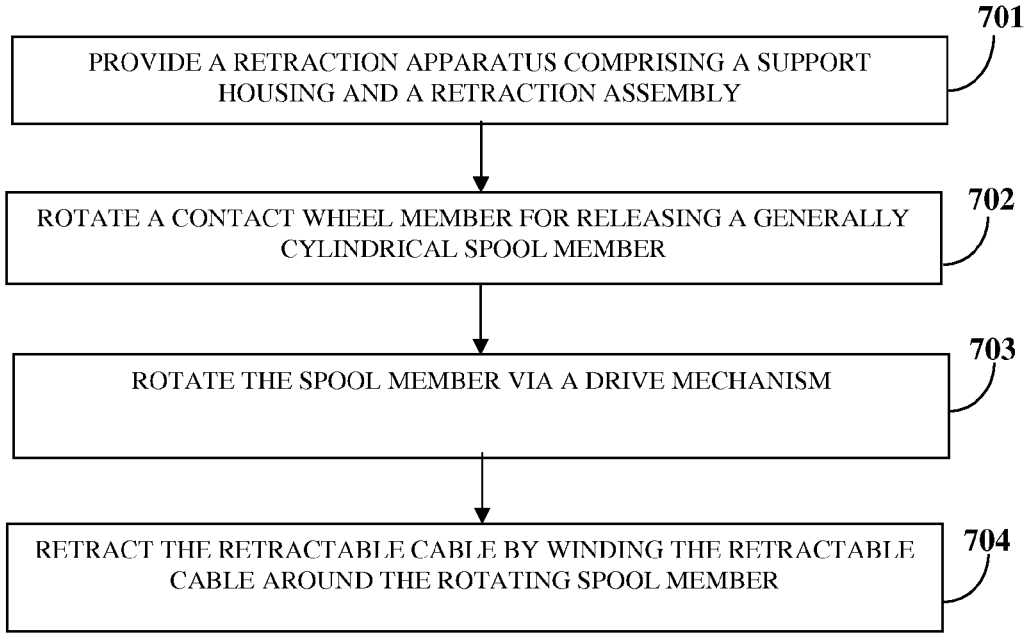
FIG. 7 illustrates a method for retracting a retractable cable using a retraction apparatus.

FIG. 7 illustrates a method for retracting a retractable cable 107 using a retraction apparatus 100. The retraction apparatus 100, as disclosed in the detailed description of FIGS. 1A-1C, FIGS. 2A-2B, FIGS. 3A-3B, FIGS. 4A-4C, and FIGS. 5A-5C, is provided 701. The retraction apparatus 100 comprises the support housing 101 and the retraction assembly 103. The retraction assembly 103 is mounted on each of one or more generally cylindrical spindles 102 of the support housing 101. A user rotates 702 the contact wheel member 121 as disclosed in the detailed description of FIGS. 2A-2B, FIGS. 3A-3B, and FIGS. 4A-4C for releasing a spool member 105, whereby the spring member 104 is decompressed. The spool member 105 is rotated 703 via the drive mechanism 122 on rotation of the contact wheel member 121 and decompression of the spring member 104. The retractable cable 107 is retracted 704 by winding the retractable cable 107 around the rotating spool member 105.

The foregoing examples have been provided merely for the purpose of explanation and are in no way to be construed as limiting of the present invention disclosed herein. While the invention has been described with reference to various embodiments, it is understood that the words, which have been used herein, are words of description and illustration, rather than words of limitation. Further, although the invention has been described herein with reference to particular means, materials and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may effect numerous modifications thereto and changes may be made without departing from the scope and spirit of the invention in its aspects.

I claim:

1. A retraction apparatus comprising:

a support housing comprising one or more generally cylindrical spindles;

a retraction assembly mounted on each of said one or more generally cylindrical spindles of said support housing, wherein said retraction assembly comprises:

a spring member mounted on said each of said one or more generally cylindrical spindles and affixed to said support housing;

a generally cylindrical spool member affixed to said spring member, wherein said generally cylindrical spool member comprises serrated plates that define a cylindrical section between said serrated plates for accommodating a retractable cable;

said retractable cable circularly wound around said cylindrical section defined between said serrated plates of said generally cylindrical spool member, wherein said retractable cable extends outwardly from said support housing; and a contact wheel member in engageable communication with said generally cylindrical spool member via a drive mechanism and disposed in a predetermined location on said support housing, wherein said contact wheel member is rotated to engageably communicate with said drive mechanism for rotating said generally cylindrical spool member for retracting said retractable cable.

2. The retraction apparatus of claim 1, wherein said retraction assembly further comprises a latch member in engageable communication with said generally cylindrical spool member, wherein said latch member controls rotation of said generally cylindrical spool member, wherein said serrated plates of said generally cylindrical spool member comprise a plurality of projections that engageably communicate with said latch member.

3. The retraction apparatus of claim 1, wherein said serrated plates of said generally cylindrical spool member comprise a plurality of projections that engageably communicate with said contact wheel member via said drive mechanism.

4. The retraction apparatus of claim 1, wherein a first end of said retractable cable houses an earphone and/or a microphone and a second end of said retractable cable is connected to said cylindrical section defined between said serrated plates of said generally cylindrical spool member.

5. The retraction apparatus of claim 1, wherein said contact wheel member is rearwardly exposed for enabling a user to manually rotate said contact wheel member for said rotation of said generally cylindrical spool member via said drive mechanism.

6. The retraction apparatus of claim 1, wherein a section of said contact wheel member is sidewardly exposed for enabling a user to manually rotate said contact wheel member for said rotation of said generally cylindrical spool member via said drive mechanism.

7. The retraction apparatus of claim 1, wherein a surface of said generally cylindrical spool member is rearwardly exposed in absence of said contact wheel member for enabling a user to manually rotate said generally cylindrical spool member, wherein said generally cylindrical spool member comprises one or more spherical depressions on said exposed surface of said generally cylindrical spool member contactable by said user for said manual rotation.

8. The retraction apparatus of claim 1, wherein said drive mechanism comprises one or more gears in engageable communication with said generally cylindrical spool member for rotating said generally cylindrical spool member, on said rotation of said contact wheel member.

9. The retraction apparatus of claim 1, wherein said drive mechanism comprises a motor operably connected to one or more gears that engageably communicate with said generally cylindrical spool member for rotating said generally cylindrical spool member on rotation of said motor, wherein said generally cylindrical spool member is selectively rotated by one of said motor and said contact wheel member via said one or more gears.

10. The retraction apparatus of claim 1, further comprising a printed circuit board fixedly attached to said spring member and embedded in said generally cylindrical spool member, wherein said printed circuit board is in electric communication with said retractable cable circularly wound around said generally cylindrical spool member via said spring member for communicating an audio signal from an electronic device.

11. The retraction apparatus of claim 10, further comprising an electrical contact fixedly attached to said printed circuit board via one or more lead wires for electrically connecting said electronic device to said retraction assembly to communicate said audio signal from said electronic device via said retractable cable of said retraction assembly.

12. The retraction apparatus of claim 1, further comprising a first enclosing panel detachably attached to a first opposing side of said support housing for enclosing said retraction assembly, wherein said first enclosing panel exposes a surface of one of said contact wheel member and said generally cylindrical spool member for manual rotation of said contact wheel member and said generally cylindrical spool member respectively.

13. The retraction apparatus of claim 12, further comprising a second enclosing panel detachably attached to a second opposing side of said support housing for enclosing an electronic device.

14. The retraction apparatus of claim 1, wherein said spring member is compressed when said retractable cable is outwardly extended from said support housing, and wherein said spring member is decompressed when said retractable cable is retracted into said support housing.

15. A retraction apparatus comprising:

a support housing comprising one or more generally cylindrical spindles;

a retraction assembly mounted on each of said one or more generally cylindrical spindles of said support housing, wherein said retraction assembly comprises:

a spring member mounted on said each of said one or more generally cylindrical spindles and affixed to said support housing;

a generally cylindrical spool member affixed to said spring member, wherein said generally cylindrical spool member comprises serrated plates that define a cylindrical section between said serrated plates for accommodating a retractable cable;

said retractable cable circularly wound around said cylindrical section defined between said serrated plates of said generally cylindrical spool member, wherein said retractable cable extends outwardly from said support housing;

a latch member in engageable communication with said generally cylindrical spool member, wherein said latch member controls rotation of said generally cylindrical spool member; and a contact wheel member in engageable communication with said generally cylindrical spool member via a drive mechanism, and disposed in a predetermined location on said support housing, wherein said contact wheel member is rotated to engageably communicate with said drive mechanism for rotating said generally cylindrical spool member for retracting said retractable cable.

16. A method for retracting a retractable cable, comprising:

providing a retraction apparatus comprising:

a support housing comprising one or more generally cylindrical spindles;

a retraction assembly mounted on each of said one or more generally cylindrical spindles of said support housing, wherein said retraction assembly comprises:

a spring member mounted on said each of said one or more generally cylindrical spindles and affixed to said support housing, wherein said spring member is compressed when said retractable cable is outwardly extended from said support housing;

a generally cylindrical spool member affixed to said spring member, wherein said generally cylindrical spool member comprises serrated plates that define a cylindrical section between said serrated plates for accommodating said retractable cable;

said retractable cable circularly wound around said cylindrical section defined between said serrated plates of said generally cylindrical spool member, wherein said retractable cable extends outwardly from said support housing; and a contact wheel member in engageable communication with said generally cylindrical spool member via a drive mechanism and disposed in a predetermined location on said support housing;

rotating said contact wheel member by a user for releasing said generally cylindrical spool member, whereby said spring member is decompressed;

rotating said generally cylindrical spool member via said drive mechanism on said rotation of said contact wheel member and said decompression of said spring member; and retracting said retractable cable by winding said retractable cable around said rotating generally cylindrical spool member.

17. The method of claim 16, wherein said retraction assembly further comprises a latch member in engageable communication with said generally cylindrical spool member for controlling rotation of said generally cylindrical spool member, and wherein said rotation of said generally cylindrical spool member in a first direction disengages said latch member from said generally cylindrical spool member to release said generally cylindrical spool member for said retraction of said retractable cable, and wherein said latch member prevents said rotation of said generally cylindrical spool member in a second direction opposing said first direction.

18. The method of claim 16, wherein said rotation of said generally cylindrical spool member is performed by said drive mechanism comprising one or more gears in engageable communication with said generally cylindrical spool member, on said rotation of said contact wheel member.

19. The method of claim 16, wherein said rotation of said generally cylindrical spool member is performed by said drive mechanism comprising a motor operably connected to one or more gears that engageably communicate with said generally cylindrical spool member, on rotation of said motor, wherein said generally cylindrical spool member is selectively rotated by one of said motor and said contact wheel member via said one or more gears.

20. A method for assembling a retraction apparatus, comprising:

providing a support housing comprising one or more generally cylindrical spindles, and a retraction assembly mountable on each of said generally cylindrical spindles, wherein said retraction assembly comprises a spring member, a generally cylindrical spool member, a retractable cable, and a contact wheel member;

mounting said spring member on said each of said one or more generally cylindrical spindles and affixing said spring member to said support housing;

affixing said generally cylindrical spool member to said spring member, wherein said generally cylindrical spool member comprises serrated plates that define a cylindrical section between said serrated plates for accommodating said retractable cable;

circularly winding said retractable cable around said cylindrical section defined between said serrated plates of said generally cylindrical spool member, wherein said retractable cable extends outwardly from said support housing;

disposing said contact wheel member in a predetermined location on said support housing and engageably connecting said contact wheel member to said generally cylindrical spool member via a drive mechanism, wherein said contact wheel member is rotated to engageably communicate with said drive mechanism for rotating said generally cylindrical spool member for retracting said retractable cable;

detachably attaching a first enclosing panel to a first opposing side of said support housing for enclosing said retraction assembly, wherein said first enclosing panel exposes a surface of one of said contact wheel member and said generally cylindrical spool member for manual rotation of said contact wheel member and said generally cylindrical spool member respectively; and detachably attaching a second enclosing panel to a second opposing side of said support housing for enclosing an electronic device.

21. The method of claim 20, wherein said retraction assembly further comprises a latch member, wherein said latch member is engageably connected to said generally cylindrical spool member for controlling rotation of said generally cylindrical spool member for retracting said retractable cable.

22. The method of claim 20, further comprising fixedly attaching a printed circuit board to said spring member and embedding said fixedly attached printed circuit board in said generally cylindrical spool member, wherein said printed circuit board is in electric communication with said retractable cable circularly wound around said generally cylindrical spool member via said spring member for communicating an audio signal from said electronic device.

23. The method of claim 22, further comprising fixedly attaching an electrical contact to said printed circuit board via one or more lead wires for electrically connecting said electronic device to said retraction assembly to communicate said audio signal from said electronic device via said retractable cable of said retraction assembly.

24. The method of claim 20, wherein said drive mechanism comprises one or more gears, wherein said one or more gears are engageably connected to said generally cylindrical spool member for rotating said generally cylindrical spool member on said rotation of said contact wheel member.

25. The method of claim 20, wherein said drive mechanism comprises a motor operably connected to one or more gears that are engageably connected to said generally cylindrical spool member for rotating said generally cylindrical spool member on rotation of said motor.

* * * * *